US011629438B2

(12) United States Patent
Martikainen et al.

(10) Patent No.: US 11,629,438 B2
(45) Date of Patent: Apr. 18, 2023

(54) INDUSTRIAL TEXTILE

(71) Applicant: Valmet Technologies Oy, Espoo (FI)

(72) Inventors: Hannu Martikainen, Espoo (FI); Mari Seppänen, Espoo (FI); Seppo Taipale, Espoo (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 20 days.

(21) Appl. No.: 17/553,301

(22) Filed: Dec. 16, 2021

(65) Prior Publication Data

US 2022/0195642 A1 Jun. 23, 2022

(30) Foreign Application Priority Data

Dec. 23, 2020 (FI) ..... 20206371

(51) Int. Cl.

| | |
|---|---|
| ***D03D 11/00*** | (2006.01) |
| ***D03D 1/00*** | (2006.01) |
| ***D21F 1/00*** | (2006.01) |
| *D21F 7/08* | (2006.01) |

(52) U.S. Cl.
CPC ..... *D03D 11/00* (2013.01); *D03D 1/00* (2013.01); *D21F 1/0036* (2013.01)

(58) Field of Classification Search
CPC ..... D03D 11/00; D03D 1/00; D03D 13/00; D03D 1/0094; D03D 3/04; D21F 1/0036; D21F 1/0045; D21F 7/10; D21F 1/0027; D21F 1/10
See application file for complete search history.

(56) References Cited

U.S. PATENT DOCUMENTS 4,161,195 A * 7/1979 Khan ..... D21F 1/0027 28/142
4,982,766 A * 1/1991 Taipale ..... D21F 1/0036 162/903
4,985,084 A * 1/1991 Hakkarainen ..... D21F 1/0036 162/903

(Continued)

FOREIGN PATENT DOCUMENTS

EP 1936024 A1 6/2008
EP 16870051 A 10/2018

(Continued)

OTHER PUBLICATIONS

Finnish Patent and Registration Office Search Report for FI 20206371, dated Jun. 3, 2021.

(Continued)

*Primary Examiner* — Robert H Muromoto, Jr.
(74) *Attorney, Agent, or Firm* — Stiennon & Stiennon

(57) ABSTRACT

An industrial textile has two layers, a web-side layer and a wear-side layer. The web-side layer has machine direction yarns (1) and binding cross-machine direction yarns (5). The wear-side layer has machine direction yarns (3) and cross-machine direction yarns (4). The binding cross-machine direction yarns (5) extend from the web-side layer to the wear-side layer and bind a portion of the wear-side layer machine direction yarns (3) to bond the web-side layer and the wear-side layer together, and wherein the web-side layer is a non-plain weave.

20 Claims, 7 Drawing Sheets

(56) References Cited

U.S. PATENT DOCUMENTS

| | | | | | |
|---|---|---|---|---|---|
| 5,052,448 | A * | 10/1991 | Givin | D21F 1/0045 | 139/414 |
| 5,839,479 | A * | 11/1998 | Gulya | D21F 1/0027 | 162/902 |
| 6,354,335 | B1 * | 3/2002 | Taipale | D21F 1/0045 | 139/383 A |
| 7,270,152 | B2 * | 9/2007 | Ueda | D21F 1/0036 | 139/383 A |
| 7,306,014 | B2 * | 12/2007 | Nagura | D21F 1/0036 | 442/205 |
| 2005/0085148 | A1 * | 4/2005 | Baumgartner | B28B 1/527 | 156/60 |
| 2006/0116042 | A1 * | 6/2006 | Nagura | D21F 1/0036 | 442/205 |
| 2008/0169040 | A1 * | 7/2008 | Barrett | D21F 1/0036 | 162/903 |
| 2018/0355555 | A1 * | 12/2018 | Taipale | D21F 1/0045 | |
| 2021/0102339 | A1 | 4/2021 | Enqvist | | |
| 2022/0195642 | A1 * | 6/2022 | Martikainen | D21F 1/0045 | |

FOREIGN PATENT DOCUMENTS

| | | | |
|---|---|---|---|
| JP | 2008025060 | A | 2/2008 |
| WO | 03093573 | A1 | 11/2003 |

OTHER PUBLICATIONS

U.S. Appl. No. 17/338,471, first named inventor, Hannu Martikainen, filed Jun. 3, 2021.

* cited by examiner

INDUSTRIAL TEXTILE

CROSS REFERENCES TO RELATED APPLICATIONS

This application claims priority on FI 20206371, filed Dec. 23, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an industrial textile consisting of two layers, a web-side layer and a wear-side layer. Particularly, the invention relates to an industrial textile having no additional stitching yarn.

Triple-layer fabric structures are formed of two distinct fabric layers. The two fabric layers are stitched together by additional stitching yarns for forming a single fabric structure. The fabric layers are stitched together so that the layers are stacked relative to each other. Thus, machine direction yarns of the layers are overlapping. This enables formation of uniform drainage paths thought the fabric structure. However, during dewatering, the flow of water is so strong that some of the fibers go through the fabric with the flow and some can even stick to the fabric structure and clog the fabric.

SSB (sheet support binding) structures are multilayer fabric structures having two machine direction yarn systems and three cross-machine direction yarn systems. One of the cross-machine direction yarn systems consists of binding yarn pairs that bind the web-side and wear-side layers together and also participate in forming the web-side layer. Because two binding cross-machine direction yarns are required to form one continuous cross-machine direction yarn path, the cross-machine yarn density becomes quite high. As a result, more material is needed to manufacture the product and it becomes more expensive to manufacture. In addition, the production efficiency decreases.

EP16870051 discloses a paper machine fabric structure that consists of two layers, a paper-side layer and a wear-side layer. The paper-side layer consists of the machine direction yarns and at least the binding cross-machine direction yarns, which have been configured to form a part of the paper-side surface and bind the two layers together. However, the machine direction yarns of the paper-side layer and the wear-side layer are stacked. Thus, during dewatering some of fibers go through the fabric with the flow and some can even stick to the fabric structure and clog the fabric.

SUMMARY OF THE INVENTION

The object of the invention is to provide an industrial textile which is thin, less expensive and faster to manufacture and which stays clean during use.

According to a first aspect of the present invention, there is provided an industrial textile comprising two layers, a web-side layer and a wear-side layer, where: the web-side layer comprises machine direction yarns and binding cross-machine direction yarns, the wear-side layer comprises machine direction yarns and cross-machine direction yarns, the binding cross-machine direction yarns extend from the web-side layer to the wear-side layer and bind a portion of the wear-side layer machine direction yarns to bond the web-side layer and the wear-side layer together, and wherein the web-side layer is a non-plain weave.

According to an embodiment of the present invention, the web-side layer machine direction yarns and the wear-side layer machine direction yarns are partially or fully unstacked.

According to an embodiment of the present invention, the binding cross-machine direction yarns are configured to bind the web-side layer machine direction yarns in a five-shaft weave over one, under one, over one and under two web-side layer machine direction yarns, in a six-shaft weave under one, over one, under two, over one, under one, over one, under two, over one, under one and over one web-side layer machine direction yarns, or in an eight-shaft weave under two, over one, under one, over one, under two, over one web-side layer machine direction yarns.

According to an embodiment of the present invention, the binding cross-machine direction yarns bind the portion of wear-side layer machine direction yarns while the binding cross-machine direction yarns bind the web-side layer machine direction yarns under two web-side layer machine direction yarns.

According to an embodiment of the present invention, the binding cross-machine direction yarns are configured to bind every fifth of the wear-side layer machine direction yarns.

According to an embodiment of the present invention, the binding cross-machine direction yarns bind a portion of wear-side layer machine direction yarns to form binding points under the web-side layer.

According to an embodiment of the present invention, the binding cross-machine direction yarns are configured to form a continuous independent yarn path.

According to an embodiment of the present invention, the web-side layer comprises cross-machine direction yarns configured to only bind the web-side layer machine direction yarns.

According to an embodiment of the present invention, at least one of the web-side layer cross-machine direction yarns is configured between two adjacent binding cross-machine direction yarns.

According to an embodiment of the present invention, the web-side layer cross-machine direction yarns are configured to bind the web-side layer machine direction yarns over one, under one, over one and under two machine direction yarns.

According to an embodiment of the present invention, the wear-side layer is a five-shaft weave or a ten-shaft weave.

According to an embodiment of the present invention, the wear-side layer is a five-shaft weave, wherein the wear-side layer cross-machine direction yarns are configured to bind the wear-side layer machine direction yarns over one and under four machine direction yarns.

According to an embodiment of the present invention, the wear-side layer is a ten-shaft weave, wherein the wear-side layer cross-machine direction yarns are configured to bind the wear-side layer machine direction yarns over two and under eight machine direction yarns.

According to an embodiment of the present invention, the wear-side layer is a ten-shaft weave, wherein the wear-side layer cross-machine direction yarns are configured to bind the wear-side layer machine direction yarns over one, under one, over one and under seven machine direction yarns.

According to an embodiment of the present invention, the wear-side layer is a ten-shaft weave, wherein the wear-side layer cross-machine direction yarns are configured to bind the wear-side layer machine direction yarns over one, under two, over one and under six machine direction yarns.

According to an embodiment of the present invention, the ratio of the web-side layer machine direction yarns to the wear-side layer machine direction yarns is 1:1, 1:2 or 2:1.

According to an embodiment of the present invention, the ratio of the web-side layer cross-machine direction yarns to the wear-side layer cross-machine direction yarns is 3:2, 2:1, 1:1, 1:2, 2:3 or 8:5.

DESCRIPTION OF THE PREFERRED EMBODIMENTS

Figure 1:
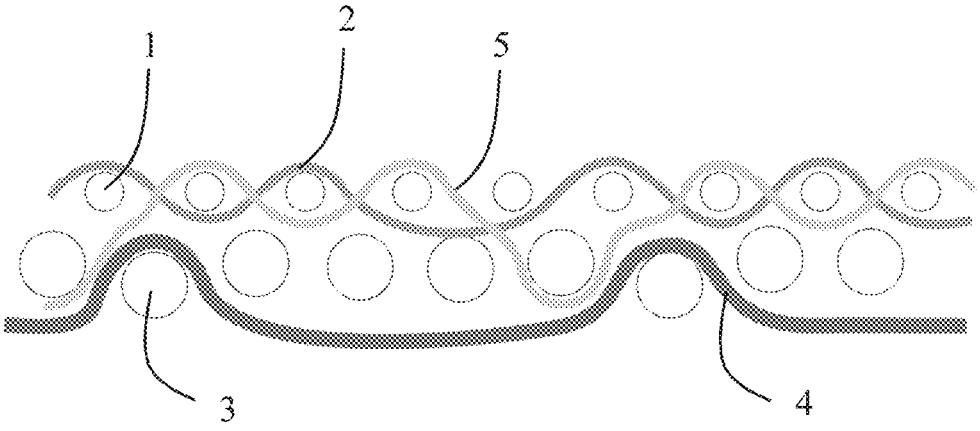
FIG. 1 illustrates a textile structure as viewed in the direction of machine direction yarns in accordance with at least some embodiments of the present invention.

In the present context, the term "web-side layer" refers to a side of a textile which is in contact with paper, board or tissue produced when the textile is assembled in a paper, board or tissue machine.

In the present context, the term "wear-side layer" refers to a side of the textile which is in contact with a paper, board or tissue machine equipment when the textile is assembled to the paper, board or tissue machine.

In the present context, the term "machine direction" refers to a moving direction of the textile in the paper, board or tissue machine when the textile is assembled to the paper, board or tissue machine.

In the present context, the term "cross-machine direction" refers to a direction, which is perpendicular to the moving direction of the textile in the paper, board or tissue machine when the textile is assembled to the paper, board or tissue machine.

In the present context, the term "non-plain weave" refers to a weave, which is not a plain weave in which cross-machine direction yarns pass over one and under one machine direction yarns. Instead, the weave is configured to change during a pattern repeat.

In the present context, the term "fully unstacked" refers to a textile structure, wherein the web-side layer machine direction yarns and the wear-side layer machine direction yarns do not overlap, but they are laterally displaced to avoid stacking.

In the present context, the term "partially unstacked" refers to a textile structure wherein at least some of the web-side layer machine direction yarns and the wear-side layer machine direction yarns do not overlap, but they are laterally displaced to avoid stacking.

According to some embodiments an industrial textile comprises two layers, a web-side layer and a wear-side layer. The web-side layer comprises machine direction yarns 1 and binding cross-machine direction yarns 5. The wear-side layer comprises machine direction yarns 3 and cross-machine direction yarns 4. The binding cross-machine direction yarns 5 extend from the web-side layer to the wear-side layer and bind a portion of wear-side layer machine direction yarns to bond the web-side layer and the wear-side layer together. The web-side layer is a non-plain weave. Thus, the weave is configured to change during a pattern repeat of the web-side layer. For example, first, the binding cross-machine direction yarns 5 can be configured to bind under one and over one web-side layer machine direction yarns 1. Then, the weave can be changed. The binding cross-machine direction yarns 5 can be configured to bind under two web-side layer machine direction yarns 1. The pattern is repeated in the row. The same pattern can be repeated with alternate yarns in the following row. The binding cross-machine direction yarns 5 bind the two layers together while forming a portion of the web-side layer. Thanks to this, the weaving time is reduced and production costs are decreased, and additional stitching yarns become superfluous.

According to some embodiments, the web-side layer machine direction yarns 1 and the wear-side layer machine direction yarns 3 are partially or fully unstacked. This enables 5 to 15% thinner textile than generally used paper machine fabrics, such as SSB fabrics. Due to the thinner structure, formation of a paper web and water removal improve. More effective water removal reduces the load of the paper machine. Reducing the paper machine load makes it possible to increase machine speed. This in turn increases productivity.

A thin structure is also an advantage when the aim is to improve the dry matter content of the paper web. The reason for a poor dry content in thick textile structures is a large water space that increases the rewetting phenomenon. In rewetting, water drained from a paper web to a wire is being absorbed back to the paper web in the wire section, after the dewatering elements. When the paper web is drier as it enters the press section, there are fewer breaks and the consumption of steam at the press section is reduced. This saves energy. The increase of dry content by one percent at the wet wire section may already make it possible to raise the speed of the paper machine to a new level.

Further, due to the partially or fully unstacked structure, there are few, if any, openings extending transversally straight through the textile from the web-side layer to the wear-side layer. Therefore, during dewatering, the flow of fibers through the textile structure and, consequently, clogging of the textile structure by fibers which adhere to the textile structure is minimized. Further, the void volume of the textile is reduced, which enables it to stay clean. Due to the low void volume, the textile carries less fibers and water.

According to some embodiments, the binding cross-machine direction yarns 5 are configured to bind the web-side layer machine direction yarns 1 in a five-shaft weave, a six-shaft weave or an eight-shaft weave. In the five-shaft weave the binding cross-machine direction yarns 5 are configured to bind the web-side layer machine direction yarns 1 over one, under one, over one and under two web-side layer machine direction yarns 1. In the six-shaft weave the binding cross-machine direction yarns 5 are configured to bind the web-side layer machine direction yarns 1 under one, over one, under two, over one, under one, over one, under two, over one, under one and over one web-side layer machine direction yarns 1. In the eight-shaft weave the binding cross-machine direction yarns 5 are configured to bind the web-side layer machine direction yarns 1 under two, over one, under one, over one, under two, over one web-side layer machine direction yarns 1. Thus, the binding cross-machine direction yarn floats are short, which reduces internal wear and increases stability.

In addition, the binding cross-machine direction yarns 5 can be configured to bind the web-side layer machine direction yarns 1 in a three-shaft or a seven-shaft weave (not illustrated in figures). In the three-shaft weave the binding cross-machine direction yarns 5 are configured to bind the web-side layer machine direction yarns 1 over one and under two web-side layer machine direction yarns 1. In the seven-shaft weave the binding cross-machine direction yarns 5 are configured to bind the web-side layer machine direction yarns 1 over one, under one, over one, under one, over one and under two web-side layer machine direction yarns 1.

In addition, the binding cross-machine direction yarns 5 can be configured to bind the web-side layer machine direction yarns 1 in a nine-shaft weave, a ten-shaft weave or a twelve-shaft weave (not illustrated in the figures). In the nine-shaft weave the binding cross-machine direction yarns 5 are configured to bind the web-side layer machine direction yarns 1 over one, under one, over one, under one, over one, under one, over one and under two web-side layer machine direction yarns 1. In the ten-shaft weave the binding cross-machine direction yarns 5 are configured to bind the web-side layer machine direction yarns 1 under one, over one, under one, over one, under one, over one, under one, over one and under two web-side layer machine direction yarns 1. In the twelve-shaft weave the binding cross-machine direction yarns 5 are configured to bind the web-side layer machine direction yarns 1 under one, over one, under one, over one, under one, over one, under one, over one, under one, over one and under two web-side layer machine direction yarns 1.

Figure 2:
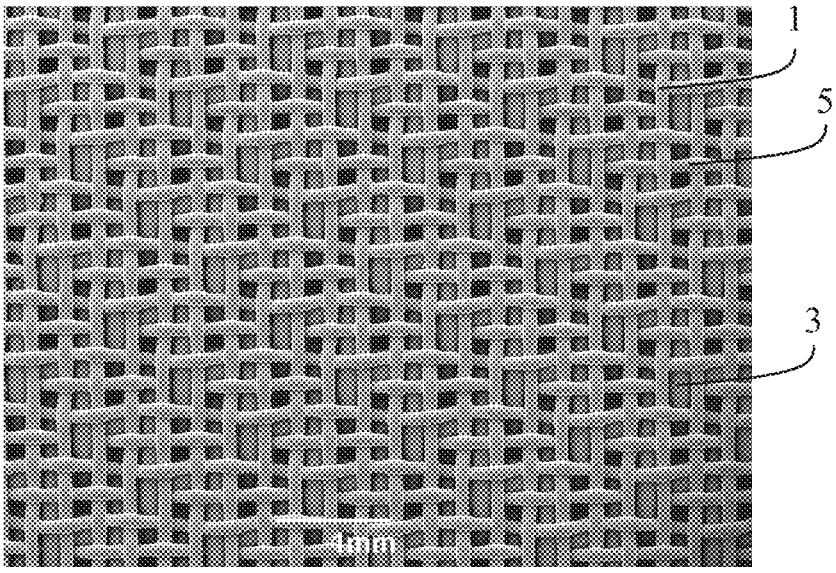
FIG. 2 illustrates the textile structure of FIG. 1 as viewed from a web-side in accordance with at least some embodiments of the present invention.

FIG. 1 illustrates a textile structure as viewed in the direction of machine direction yarns and FIG. 2 illustrates the said textile structure as viewed from the web-side. The web-side layer is a five-shaft weave. Thus, the binding cross-machine direction yarns 5 are configured to bind the web-side layer machine direction yarns 1 over one, under one, over one and under two web-side layer machine direction yarns 1. The binding cross-machine direction yarn floats are short, which reduces internal wear and increases stability.

FIG. 1 illustrates that the binding cross-machine direction yarns 5 bind the portion of wear-side layer machine direction yarns 3 while the binding cross-machine direction yarns 5 bind the web-side layer machine direction yarns 1 under two web-side layer machine direction yarns 1. This enables the forming of the partially or fully unstacked structure.

FIG. 1 illustrates that the binding cross-machine direction yarns 5 are configured to bind every fifth of the wear-side layer machine direction yarns 3. Thus, the every fifth of the wear-side layer machine direction yarns 3 participates in bonding the web-side layer and the wear-side layer together.

Figure 3:
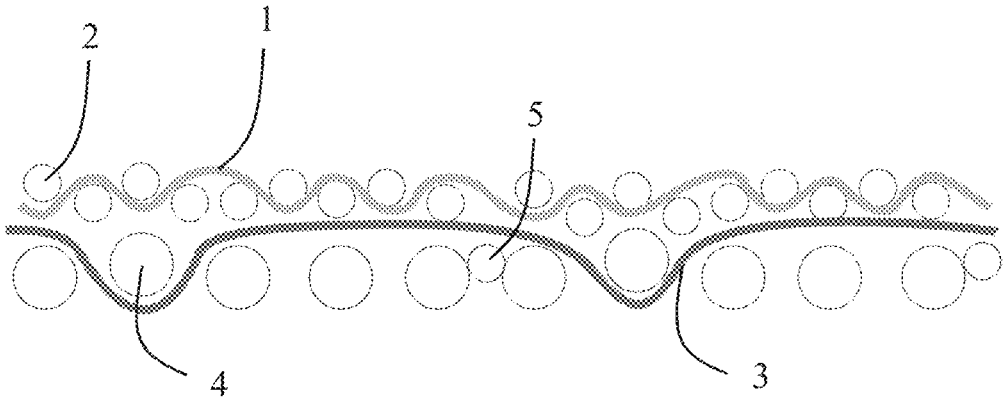
FIG. 3 illustrates the textile structure of FIG. 1 as viewed in the direction of cross-machine direction yarns in accordance with at least some embodiments of the present invention.

FIG. 3 illustrates the textile structure of FIGS. 1 and 2 as viewed in the direction of machine direction yarns. The binding cross-machine direction yarns 5 bind a portion of the wear-side layer machine direction yarns 3 to form binding points under the web-side layer. The wear-side layer machine direction yarns 3 can move from the line of other wear-side layer machine direction yarns 3 towards to the web-side layer. However, the binding points stay under the web-side layer. Thus, binding of the wear-side layer machine direction yarns 3 by the binding cross-machine direction yarns 5 is achieved so that the formed binding point does not reach the surface of the web-side layer. Therefore, the binding point does not clog the textile. Thanks to this, water permeability of the textile does not substantially decrease despite the partially or fully unstacked structure. Further, the cross-machine direction yarns are straighter in the final structure. This minimizes stretching of the textile in the paper machine.

According to some embodiments, the binding cross-machine direction yarns 5 are configured to form a continuous independent yarn path. Thus, one binding cross-machine direction yarn is required to form one continuous binding cross-machine direction yarn path. This provides lower cross-machine direction yarn density. Thus, less material is needed to manufacture the textile and it becomes less expensive to manufacture. In addition, the textile is 15 to 25% faster to weave than a textile having two binding cross-machine direction yarns forming the continuous yarn path together.

According to some embodiments, the web-side layer further comprises cross-machine direction yarns 2 configured to only bind the web-side layer machine direction yarns 1. So, the yarns only participate in the formation of the web-side layer.

According to some embodiments, at least one of the web-side layer cross-machine direction yarns 2 can be configured between two adjacent binding cross-machine direction yarns 5. Thus, there can be only one web-side layer cross-machine direction yarn 2 between two adjacent binding cross-machine direction yarns 5, and the web-side layer cross-machine direction yarns 2 form a continuous independent yarn path. Then, the web-side layer cross-machine direction yarns 2 and the binding cross-machine direction yarns 5 alternate in the web-side layer. This provides a lower cross-machine direction yarn density. Thus, less material is needed to manufacture the textile and it becomes less expensive to manufacture. In addition, the textile is 15 to 25% faster to weave than a textile having two cross-machine direction yarns forming the continuous yarn path together.

Alternatively, there can be for example, two web-side layer cross-machine direction yarns 2 between two adjacent binding cross-machine direction yarns 5.

The web-side layer cross-machine direction yarns 2 can be configured to bind the web-side layer machine direction yarns 1 over one, under one, over one and under two machine direction yarns 1. Thus, the cross-machine direction yarn 2 floats are short, which reduces internal wear and increases stability.

FIGS. 4, 6, 8, 10 and 12 illustrate structures as a view from the wear-side. FIGS. 1, 5, 7, 9, 11, 13, 14 and 15 illustrate the structures as viewed in the direction of machine direction yarns. The wear-side layer can be a five-shaft weave or a ten-shaft weave. In addition, a six-shaft, an eight-shaft, a twelve-shaft or a sixteen-shaft weave can be used.

Figure 4:
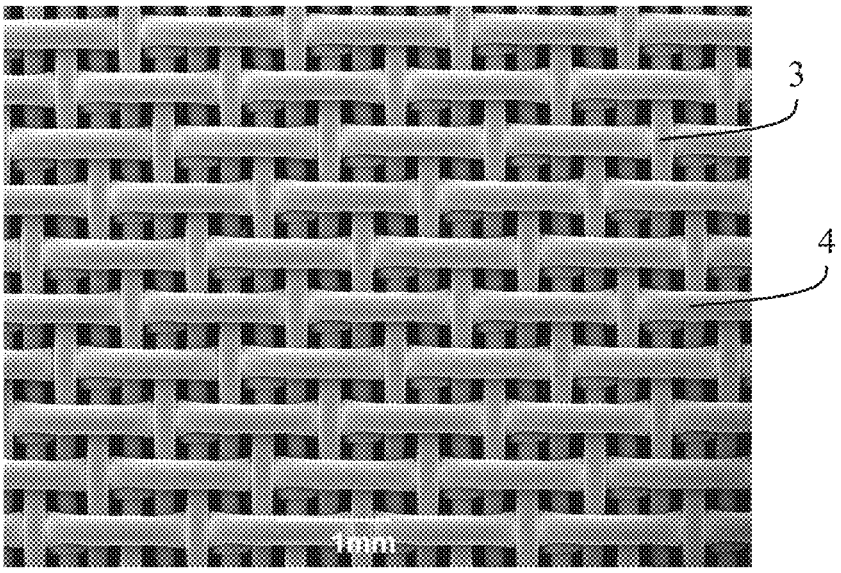
FIG. 4 illustrates a wear-side layer of the textile structure of FIG. 1 wherein the wear-side layer is a five-shaft weave as viewed from the wear-side in accordance with at least some embodiments of the present invention.
Figure 5:
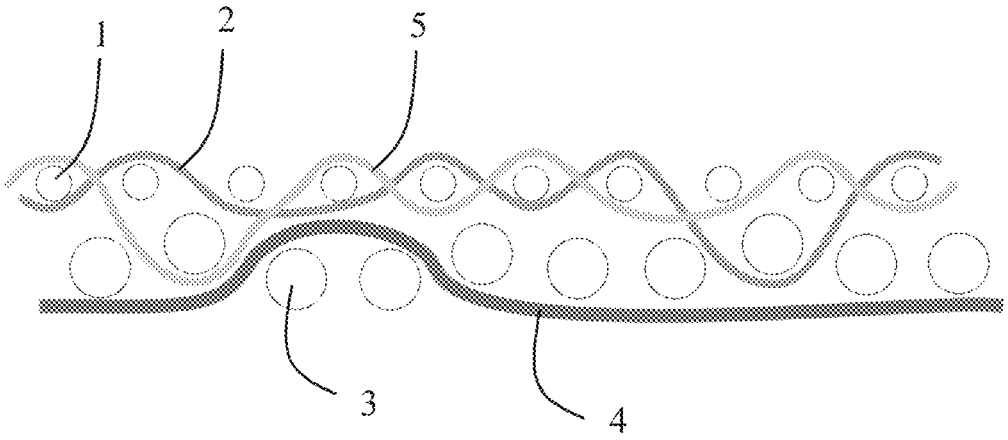
FIG. 5 illustrates a textile structure wherein a wear-side is a ten-shaft weave as viewed in the direction of machine direction yarns in accordance with at least some embodiments of the present invention.
Figure 6:
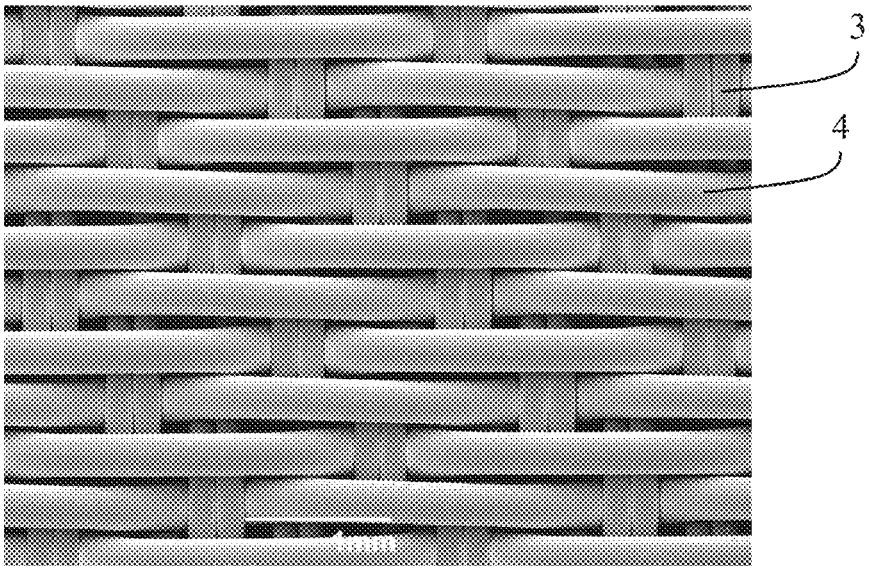
FIG. 6 illustrates the wear-side layer of the textile structure of FIG. 5 as viewed from the wear-side in accordance with at least some embodiments of the present invention.
Figure 7:
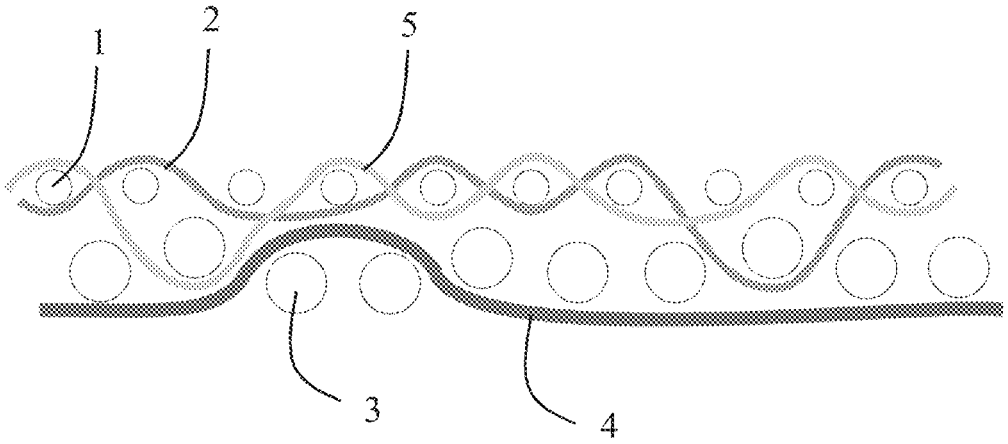
FIG. 7 illustrates a textile structure wherein a wear-side is a ten-shaft weave as viewed in the direction of machine direction yarns in accordance with at least some embodiments of the present invention.
Figure 8:
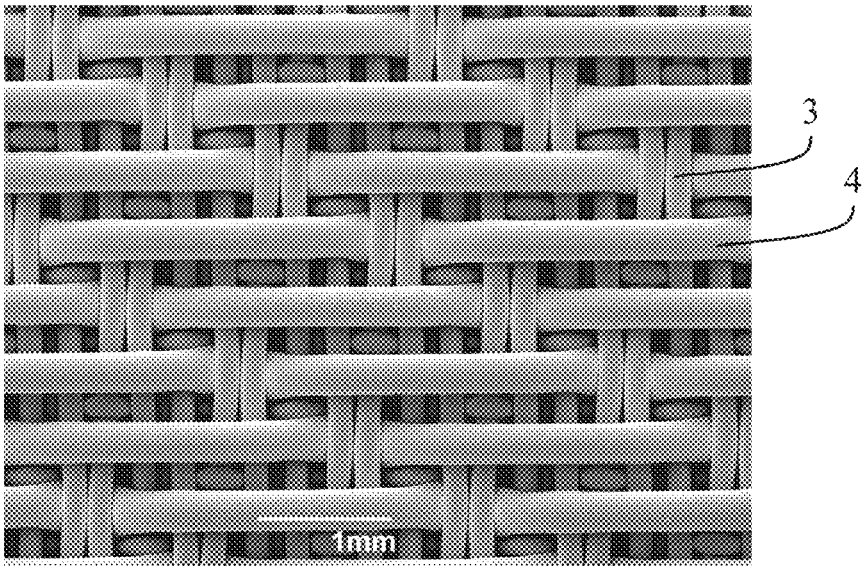
FIG. 8 illustrates the wear-side layer of the textile structure of FIG. 7 as viewed from the wear-side in accordance with at least some embodiments of the present invention.

FIGS. 1 and 4 illustrate that the wear-side layer is a five-shaft weave. The wear-side layer cross-machine direction yarns 4 are configured to bind the wear-side layer machine direction yarns 3 over one and under four machine direction yarns 3. Thus, the cross-machine direction yarn floats are relatively short, which reduces internal wear and increases stability.

FIGS. 5 to 8 illustrate that the wear-side layer is a ten-shaft weave. The wear-side layer cross-machine direction yarns 4 are configured to bind the wear-side layer machine direction yarns 3 over two and under eight machine direction yarns 3. Thus, the cross-machine direction yarn floats are relatively long, which increases wear resistance.

Figure 9:
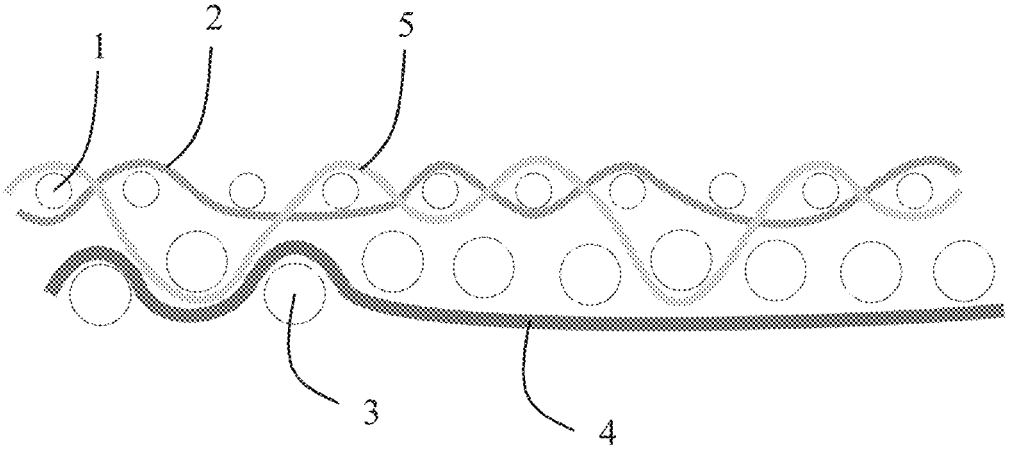
FIG. 9 illustrates a textile structure wherein a wear-side is a ten-shaft weave as viewed in the direction of machine direction yarns in accordance with at least some embodiments of the present invention.
Figure 10:
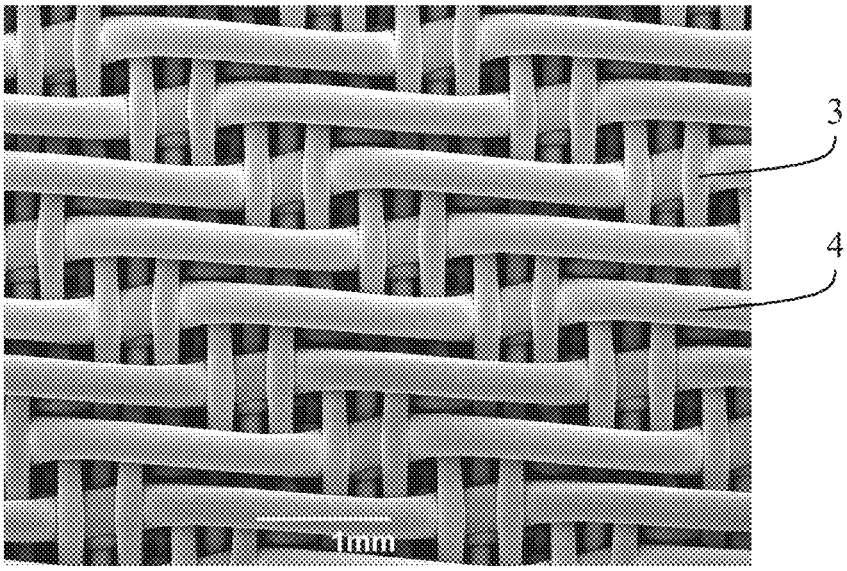
FIG. 10 illustrates the wear-side layer of the textile structure of FIG. 9 as viewed from the wear-side in accordance with at least some embodiments of the present invention.

FIGS. 9 and 10 illustrate that the wear-side layer is a ten-shaft weave. The wear-side layer cross-machine direction yarns 4 are configured to bind the wear-side layer machine direction yarns 3 over one, under one, over one and under seven machine direction yarns 3. Thus, the cross-machine direction yarn floats are relatively long, which increases wear resistance.

Figure 11:
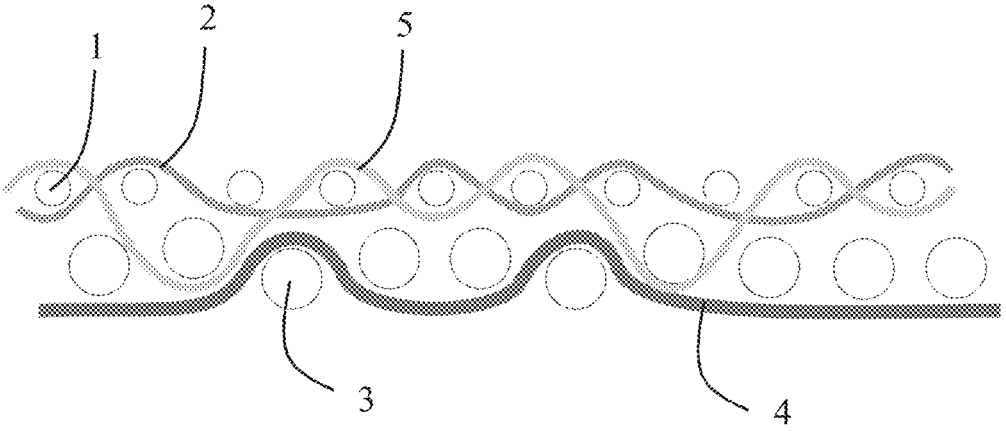
FIG. 11 illustrates a textile structure wherein a wear-side is a ten-shaft weave as viewed in the direction of machine direction yarns in accordance with at least some embodiments of the present invention.
Figure 12:
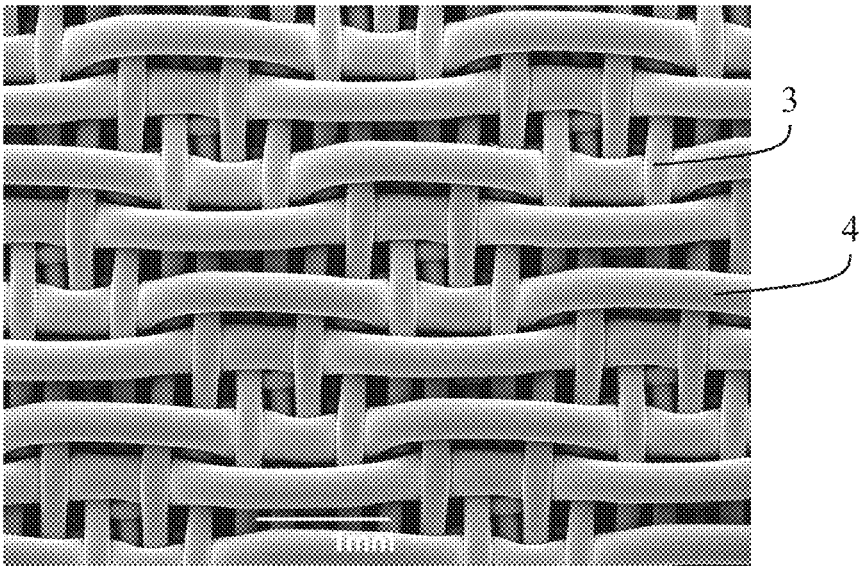
FIG. 12 illustrates the wear-side layer of the textile structure of FIG. 11 as viewed from the wear-side in accordance with at least some embodiments of the present invention.

FIGS. 11 and 12 illustrate that the wear-side layer is a ten-shaft weave. The wear-side layer cross-machine direction yarns 4 are configured to bind the wear-side layer machine direction yarns 3 over one, under two, over one and under six machine direction yarns 3. Thus, the cross-machine direction yarn floats are relatively long, which increases wear resistance.

Figure 13:
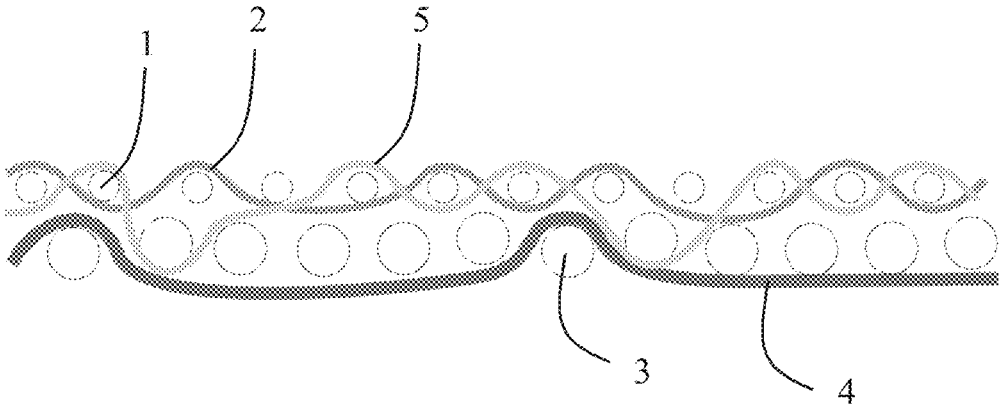
FIG. 13 illustrates a textile structure wherein a wear-side is a six-shaft weave as viewed in the direction of machine direction yarns in accordance with at least some embodiments of the present invention.

FIG. 13 illustrates that the wear-side layer is a six-shaft weave. The wear-side layer cross-machine direction yarns 4 are configured to bind the wear-side layer machine direction yarns 3 over one and under five machine direction yarns 3. Thus, the cross-machine direction yarn floats are relatively long, which increases wear resistance.

Figure 14:
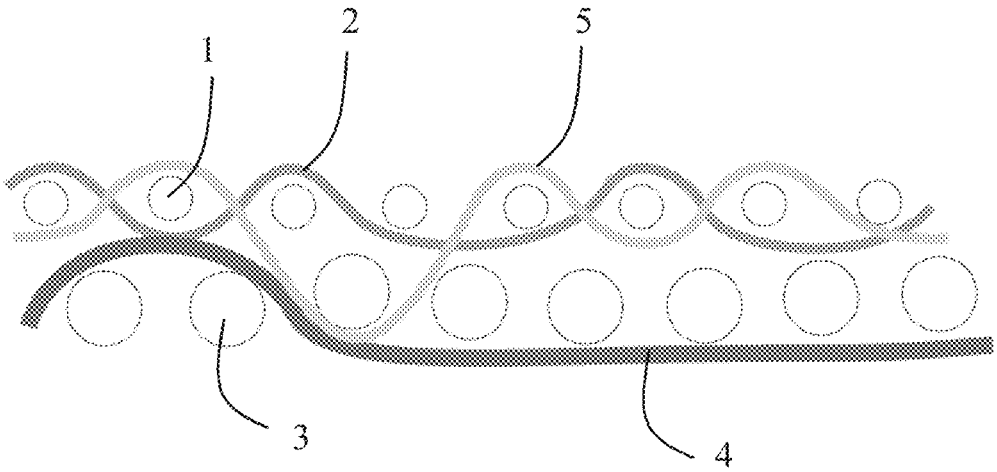
FIG. 14 illustrates a textile structure wherein a wear-side is an eight-shaft weave as viewed in the direction of machine direction yarns in accordance with at least some embodiments of the present invention.

FIG. 14 illustrates that the wear-side layer is an eight-shaft weave. The wear-side layer cross-machine direction yarns 4 are configured to bind the wear-side layer machine direction yarns 3 over two and under six machine direction yarns 3. Thus, the cross-machine direction yarn floats are relatively long, which increases wear resistance.

Figure 15:
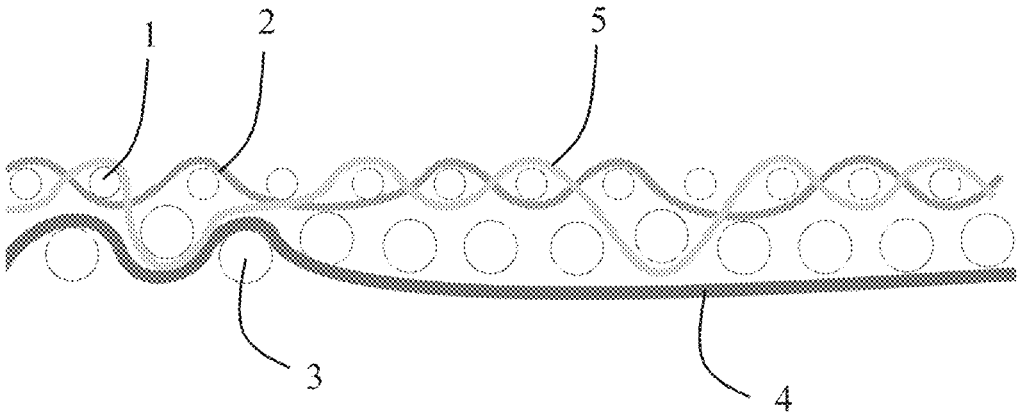
FIG. 15 illustrates a textile structure wherein a wear-side is a twelve-shaft weave as viewed in the direction of machine direction yarns in accordance with at least some embodiments of the present invention.

FIG. 15 illustrates that the wear-side layer is a twelve-shaft weave. The wear-side layer cross-machine direction yarns 4 are configured to bind the wear-side layer machine direction yarns 3 over one, under one, over one and under nine machine direction yarns 3. Thus, the cross-machine direction yarn floats are relatively long, which increases wear resistance.

According to some embodiments, the ratio of the web-side layer machine direction yarns 1 to the wear-side layer machine direction yarns 3 is preferably 1:1. In addition, the ratio can be for example, 1:2 or 2:1. In the ratio 1:1, the web-side layer machine direction yarns and the wear-side layer machine direction yarns are stacked.

However, in some embodiments, the ratio of the web-side layer machine direction yarns 1 to the wear-side layer machine direction yarns 3 can also be greater than one (>1) or less than one (<1).

According to some embodiments, the ratio of the web-side layer cross-machine direction yarns 2 to the wear-side layer cross-machine direction yarns 4 is preferably 3:2 or 2:1. However, ratios of 1:1, 1:2, 2:3 or 8:5 can also be used.

The diameters of the web-side layer yarns 1, 2, 5 can be smaller than the diameters of the wear-side layer yarns 3, 4. Thus, the diameters of web-side layer machine direction yarns 1 can be smaller than the diameters of the wear-side layer machine direction yarns. Correspondingly, the diameters of the binding cross-machine direction yarns 5 and the web-side layer cross-machine direction yarns 2 can be smaller than the wear-side layer cross-machine direction yarns 4. The web-side layer formed of thinner yarns reduces marking of a paper web. On the other hand, the wear-side layer formed of thicker yarns increases the service life of the textile.

Alternatively, the diameters of the web-side layer yarns 1, 2, 5 can be the same as the diameters of the wear-side layer yarns 3, 4. Thus, the diameters of web-side layer machine direction yarns 1 can be the same as the diameters of the wear-side layer machine direction yarns. Correspondingly, the diameters of the binding cross-machine direction yarns 5 and the web-side layer cross-machine direction yarns 2 can be the same as the wear-side layer cross-machine direction yarns 4.

The diameter of the web-side layer machine direction yarns 1 can be ≥0.08 mm and/or the diameter of the web-side layer cross-machine direction yarns 2 and the binding cross-machine direction yarns 5 can be ≥0.08 mm, preferably 0.13 mm.

The diameter of the wear-side layer machine direction yarns 3 can be ≥0.08 mm and/or the diameter of the wear-side layer cross-machine direction yarns 4 can be 0.15 to 0.50 mm, preferably 0.40 mm.

The yarns 1, 2, 3, 4, 5 of the textile can be monofilaments, but multifilaments can also be used. The cross-section of the yarns 1, 2, 3, 4, 5 can be round, square, rectangular, oval or any other suitable shape. The yarns 1, 2, 3, 4, 5 can be of man-made fibers, natural fibers or regenerated fibers. Further, recycled fibers can be used.

The yarns 1,2, 3, 4, 5 of the textile can be polyester or polyamide yarns. In addition, polyethylene naphthalate (PEN) or polyphenylene sulphide (PPS) yarns can be used.

The textile can have a weight of 280 to 1000 g/m2 and a thickness of 0.4 mm to 2 mm.

The industrial textile can be used as a wire in the wet section of a paper machine, but the structure can also be used with e.g., tissue, paperboard and non-woven machines. The structure of the invention can also be configured for use at the press or drying section of a paper machine.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e., a singular form, throughout this document does not exclude a plurality.

We claim:

1. An industrial textile comprising:

two layers, a web-side layer and a wear-side layer, wherein the web-side layer comprises machine direction yarns and binding cross-machine direction yarns;

wherein the wear-side layer comprises machine direction yarns and cross-machine direction yarns;

wherein the binding cross-machine direction yarns extend from the web-side layer to the wear-side layer and bind a portion of the wear-side layer machine direction yarns to bond the web-side layer and the wear-side layer together, and wherein a weave of the web-side layer is configured to change during a pattern repeat, and wherein the binding cross-machine direction yarns are configured to bind the web-side layer machine direction yarns in a five-shaft weave over one, under one, over one and under two web-side layer machine direction yarns.

2. The industrial textile of claim 1, wherein the web-side layer machine direction yarns and the wear-side layer machine direction yarns are partially or fully unstacked.

3. The industrial textile of claim 1 wherein the binding cross-machine direction yarns bind the portion of the wear-side layer machine direction yarns while the binding cross-machine direction yarns bind the web-side layer machine direction yarns under two web-side layer machine direction yarns.

4. The industrial textile of claim 1, wherein the binding cross-machine direction yarns are configured to bind every fifth of the wear-side layer machine direction yarns.

5. The industrial textile of claim 1, wherein the binding cross-machine direction yarns bind a portion of the wear-side layer machine direction yarns to form binding points under the web-side layer.

6. The industrial textile of claim 1, wherein the binding cross-machine direction yarns are configured to form a continuous independent yarn path.

7. The industrial textile of claim 1, wherein the web-side layer comprises cross-machine direction yarns configured to only bind the web-side layer machine direction yarns.

8. The industrial textile of claim 7, wherein at least one of the web-side layer cross-machine direction yarns is configured between two adjacent binding cross-machine direction yarns.

9. The industrial textile of claim 7, wherein the web-side layer cross-machine direction yarns are configured to bind the web-side layer machine direction yarns over one, under one, over one and under two machine direction yarns.

10. The industrial textile of claim 1, wherein the wear-side layer is a five-shaft weave or a ten-shaft weave.

11. The industrial textile of claim 10, wherein the wear-side layer is a five-shaft weave and wherein the wear-side layer cross-machine direction yarns are configured to bind the wear-side layer machine direction yarns over one and under four machine direction yarns.

12. The industrial textile of claim 10, wherein the wear-side layer is a ten-shaft weave and wherein the wear-side layer cross-machine direction yarns are configured to bind the wear-side layer machine direction yarns over two and under eight machine direction yarns.

13. The industrial textile of claim 10, wherein the wear-side layer is a ten-shaft weave and wherein the wear-side layer cross-machine direction yarns are configured to bind the wear-side layer machine direction yarns over one, under one, over one and under seven machine direction yarns.

14. The industrial textile of claim 10, wherein the wear-side layer is a ten-shaft weave and wherein the wear-side layer cross-machine direction yarns are configured to bind the wear-side layer machine direction yarns over one, under two, over one and under six machine direction yarns.

15. The industrial textile of claim 1, wherein the ratio of the web-side layer machine direction yarns to the wear-side layer machine direction yarns is 1:1, 1:2 or 2:1.

16. The industrial textile of claim 1, wherein the ratio of the web-side layer cross-machine direction yarns to the wear-side layer cross-machine direction yarns is 3:2, 2:1, 1:1, 1:2, 2:3 or 8:5.

17. An industrial textile comprising:

two layers, a web-side layer and a wear-side layer, wherein the web-side layer comprises machine direction yarns and binding cross-machine direction yarns;

wherein the wear-side layer comprises machine direction yarns and cross machine direction yarns;

wherein the binding cross-machine direction yarns extend from the web-side layer to the wear-side layer and bind a portion of the wear-side layer machine direction yarns to bond the web-side layer and the wear-side layer together, and wherein a weave of the web-side layer is configured to change during a pattern repeat, and wherein the binding cross-machine direction yarns are configured to bind the web-side layer machine direction yarns in a six-shaft weave under one, over one, under two, over one, under one, over one, under two, over one, under one and over one web-side layer machine direction yarns.

18. The industrial textile of claim 17, wherein the web-side layer machine direction yarns and the wear-side layer machine direction yarns are partially or fully unstacked.

19. An industrial textile comprising:

two layers, a web-side layer and a wear-side layer, wherein the web-side layer comprises machine direction yarns and binding cross-machine direction yarns;

wherein the wear-side layer comprises machine direction yarns and cross machine direction yarns;

wherein the binding cross-machine direction yarns extend from the web-side layer to the wear-side layer and bind a portion of the wear-side layer machine direction yarns to bond the web-side layer and the wear-side layer together, and wherein a weave of the web-side layer is configured to change during a pattern repeat, and wherein the binding cross-machine direction yarns are configured to bind the web-side layer machine direction yarns in an eight-shaft weave under two, over one, under one, over one, under two, over one web-side layer machine direction yarns.

20. The industrial textile of claim 19, wherein the web-side layer machine direction yarns and the wear-side layer machine direction yarns are partially or fully unstacked.

* * * * *